United States Patent [19]

Richards

[11] Patent Number: 4,530,118

[45] Date of Patent: Jul. 23, 1985

[54] PASSIVE DISPENSER

[75] Inventor: Randall G. Richards, Cincinnati, Ohio

[73] Assignee: The Drackett Company, Cincinnati, Ohio

[21] Appl. No.: 539,512

[22] Filed: Oct. 6, 1983

Related U.S. Application Data

[63] Continuation-in-part of Ser. No. 346,975, Feb. 8, 1982, Pat. No. 4,419,771.

[51] Int. Cl.[3] ..... E03D 9/02

[52] U.S. Cl. ..... 4/228; 4/227; 4/222; 222/424.5; 222/425

[58] Field of Search ..... 4/228, 227, 222, 226, 4/225; 222/54, 425, 424.5, 450, 52

[56] References Cited

U.S. PATENT DOCUMENTS

| | | | |
|---|---|---|---|
| 668,762 | 2/1901 | Thomson | 4/228 |
| 3,781,926 | 1/1974 | Levey | 4/228 |
| 3,867,101 | 2/1975 | Herring | 4/228 X |
| 4,244,062 | 1/1981 | Corsette | 4/228 |
| 4,307,474 | 12/1981 | Choy | 4/228 |
| 4,365,362 | 12/1982 | Corey | 4/228 |
| 4,407,779 | 10/1983 | Thompson | 4/228 X |
| 4,435,858 | 3/1984 | Dolan | 4/228 |

*Primary Examiner*—Henry K. Artis
*Attorney, Agent, or Firm*—Charles Zeller

[57] ABSTRACT

A passive dispenser for containing a quality of solution isolated from a body of liquid and for causing a predetermined volume of said solution to issue from the dispenser solely under conditions of gravity flow in response to the level of said body of liquid being lowered from a first elevation to a second elevation, said dispenser adapted for placement at the bottom of said body of liquid, comprising an upper section which is a cuplike member having an open bottom, the lower peripheral edge being an annular channel; a lower section which is a cuplike member having an open top, said cuplike members providing an internal reservoir for storage of cleaning solution formed upon dissolution of a water-soluble cake contained with said reservoir, the top peripheral edge of the lower section being disposed within said annular channel to define a discharge/refill conduit connecting said reservoir with the body of liquid and comprising two chambers in fluid communication with each other, one chamber being adjacent to said reservoir to form an air trap chamber and the other being adjacent to said body of liquid to form an air refill chamber, a transfer port connecting said air trap and air refill chambers, the cross-sectional area of said transfer port normal to fluid flow being smaller than the cross-sectional area of said air trap chamber normal to fluid flow such that air in said conduit is not completely displaced by said liquid when the level of the body of liquid rises from said second elevation to the first elevation, the air being entrapped in said air trap chamber and forming, upon cessation of flow into the reservoir, an air lock in said conduit that substantially isolates said solution from the body of liquid; and vent means above the discharge/refill conduit for air to vent from said reservoir.

14 Claims, 12 Drawing Figures

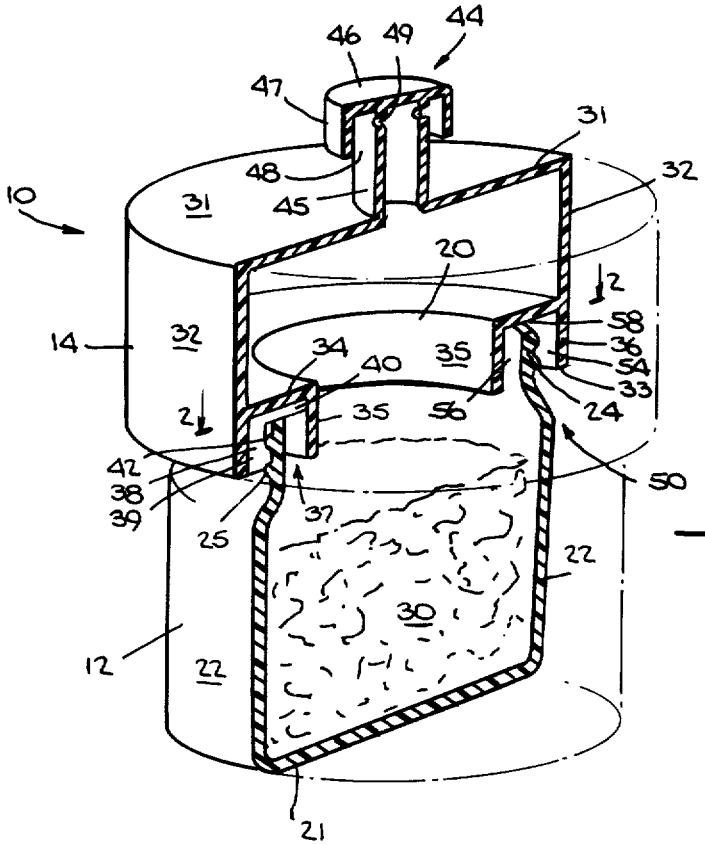
Fig. 1.
Fig. 3.
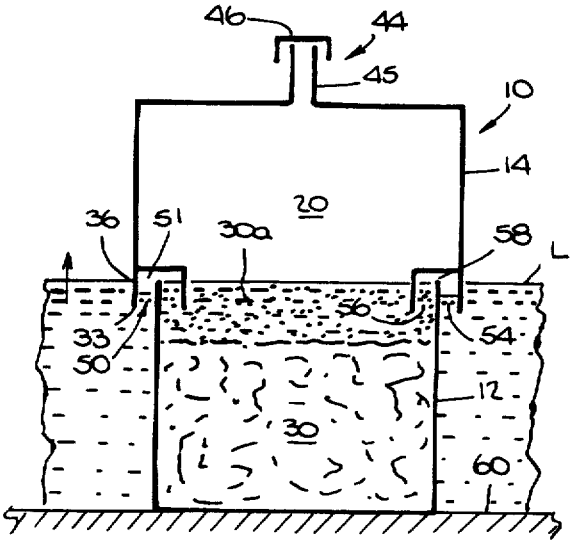
Fig. 4.
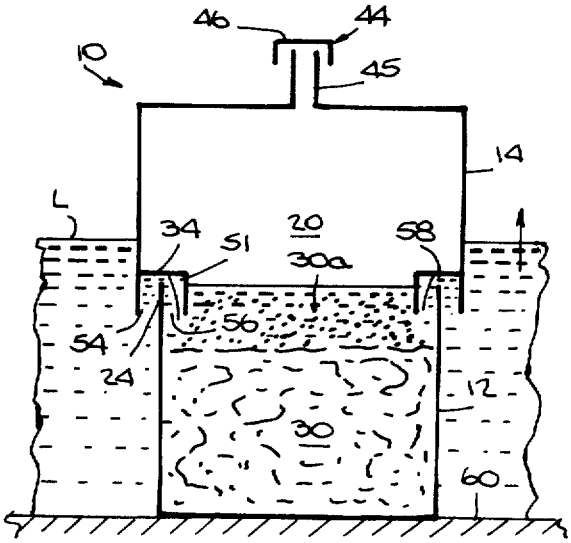

Fig. 5.
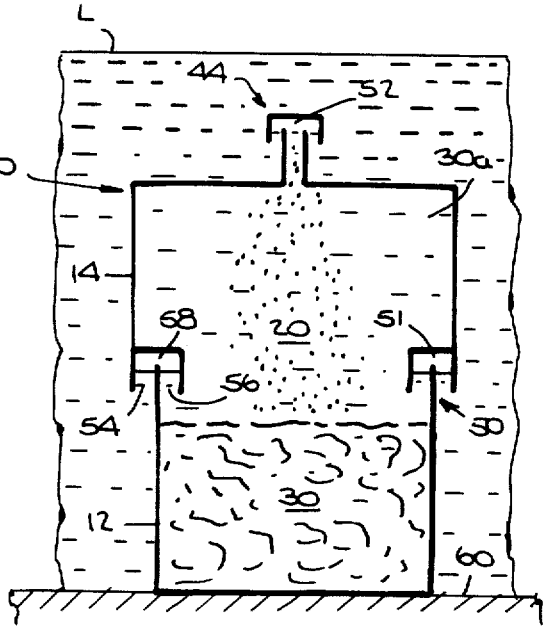
Fig. 6.
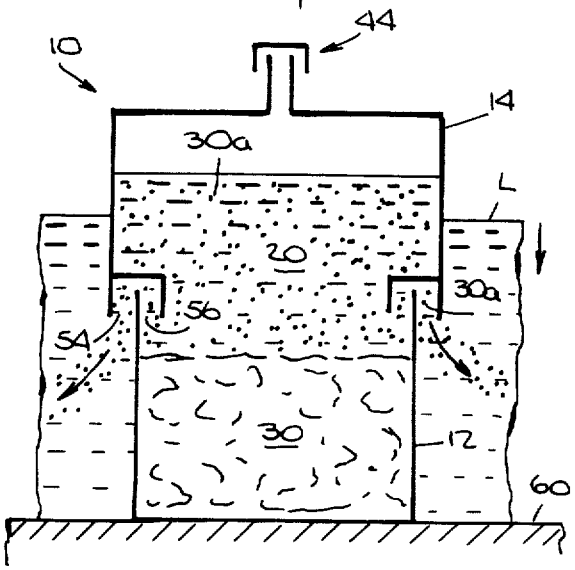
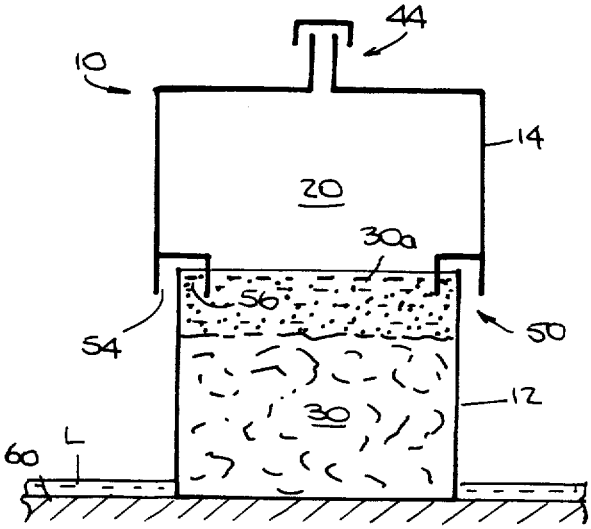
Fig. 7.
Fig. 8.
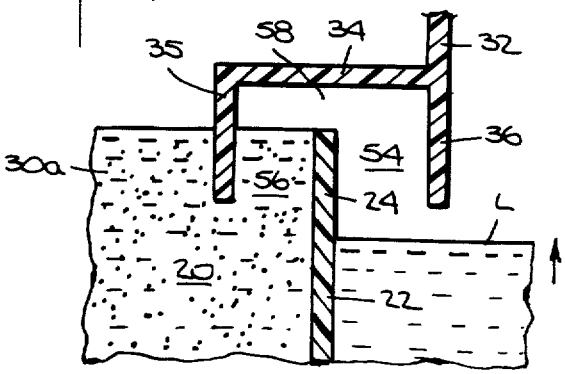

PASSIVE DISPENSER

BACKGROUND OF THE INVENTION

This is a continuation-in-part application to pending application U.S. Ser. No. 346,975 filed Feb. 8, 1982, now U.S. Pat. No. 4,419,771.

1. Field of the Invention

The present invention relates to a dosage dispenser for such products as toilet tank additives, e.g. disinfectants, detergents, and the like. More particularly, the present invention relates to a dispenser which comprises no moving parts and employs air locks to isolate the additive-containing solution to be dispensed from the water in the toilet tank during quiescent periods between flushes.

2. Description of the Prior Art

Devices for dispensing a disinfectant solution into a toilet tank for flow into the toilet bowl when the tank is flushed are known. It is generally desired to isolate the disinfectant from the water in the toilet tank during quiescent periods between flushes. To this end, it is known to use valves or other mechanisms which will shut off flow from the dispenser when the toilet tank is filled to a desired level, as illustrated by the following:

U.S. Pat. Nos. 4,036,407, Slone; 3,895,739, Buchtel; 3,784,058, Buchtel; 3,778,849, Foley; 3,698,021, Mack, et al.; 3,341,074, Pannuti; 3,339,801, Hronas; 3,073,488, Komter; 2,692,165, Sinkwich; 1,,307,535, Ciancaglini.

Passive dispensers, which are devices having no moving parts, are also known. In one type of such passive dispenser, the dispenser is alternately flooded and the siphoned when the tank is flushed. See, for example, U.S. Pat. Nos. 650,161 to Williams, et al; 1,144,525 to Blake; 1,175,032 to Williams; and 1,213,978 to Thornton. In another type, the dispenser is alternately flooded and then drained gravitationally, as shown in the following:

U.S. Pat. Nos. 4,244,062, Corsette; 3,943,582, Daeninckx, et al.; 3,781,926, Levey; 3,772,715, Nigro; 3,618,143, Moisa; 3,604,020, Hill, et al.; 3,545,014, Davis; 3,504,384, Radley, et al.; 3,121,236, Yadro, et al.; 1,987,689, Lewis.

In addition, U.S. Pat. Nos. 2,688,754 to Willets, et al; 3,864,763 to Spransy; and 3,965,497 to Corsette, and U.K. Pat. No. 705,904 disclose toilet chemical dispensers in which a small amount of the chemical is released into the tank in the absence of hydrostatic pressure on the spout thereof, e.g., when the toilet has been flushed and the water level in the tank has dropped. As the tank becomes filled with water, the resulting hydrostatic head prevents the solution from being released from the dispenser. In a further type of passive dispenser, the solution to be dispensed is connected to a pressurized water supply such as the trap refill pipe in a toilet tank. See, for example U.S. Pat. Nos. 3,407,412 and 3,444,566 each to Spear wherein the direction of flow alternates in labyrinth passages. In all of the above mentioned passive dispensers, due to the construction thereof, the disinfectant can flow or diffuse into the toilet tank water.

Passive dispensers using air locks, i.e. pockets of air, to isolate the disinfectant from the tank water during quiescent periods in a toilet tank have been disclosed. For example, U.S. Pat. Nos. 4,171,546 to Dirksing and 4,216,027 to Wages disclose passive dispensers which issue a predetermined volume of a toilet tank additive solution into a toilet tank as the water is draining therefrom when the toilet is flushed. According to these patents, an amount of a concentrated additive solution is drawn from a storage place into the tank as the water level therein drops as a result of a flush. The devices are provided with numerous baffles and passageways to form air locks that isolate the concentrated disinfectant solution from the tank water when the toilet tank is in a quiescent state. In these devices, the air locks are located at the top of the device. U.S. Pat. No. 4,186,856 to Dirksing discloses a passive dispenser having air locks formed in the top portion thereof when submerged to isolate the tank water from the disinfectant stored therein. Another passive dispenser is disclosed in U.S. Pat. No. 4,208,747 to Dirksing wherein air locks are also employed to isolate the disinfectant from tank water during quiescent periods. However, the air locks in this dispenser are disposed at different levels whereas those employed in the dispensers of U.S. Pat. Nos. 4,171,546, 4,186,856 and 4,216,027 are at the same level and in the top portion thereof. U.S. Pat. No. 4,251,012 to Owens discloses another passive dispenser in which a disinfectant is issued into a toilet tank in measured quantities. Although air locks are also used to isolate the disinfectant from the tank water, the Owens device is so constructed that the disinfectant is stored in a compartment that is not accessible to the tank water, even when the device is completely submerged. The air locks provided in this device are located at the same level near the top portion thereof.

The passive dispensers mentioned in the preceding paragraph have a common disadvantage, namely, their construction is complex. Tortuous flow paths are required in these devices. As a result, they are difficult to maunfacture. Another disadvantage is that for the devices to function properly, these devices must be hung substantially vertically in the tank. Tilting of these devices away from the wall means that the devices will extend into the center portion of the tank and interfere with the operation of the mechanisms, such as outlet valve and float linkage, in the tank. This is particularly significant in the device shown in Dirksing U.S. Pat. No. 4,208,747 which is equipped with a siphon tube. The presence of the siphon tube means that the lower end of the device is substantially below the water surface. A slight tilt away from the tank wall at the top of the tank will cause the siphon tube, because of its length, to extend into the center of the tank and substantially away from the wall.

SUMMARY OF THE INVENTION

The present invention provides a dispenser without moving parts for containing a quantity of a solution substantially isolated from a body of liquid in which the dispenser is immersed and for causing a predetermined volume of the solution to issue from the dispenser in response to the level of the body of liquid being lowered from an upper elevation to a lower one.

The dispenser comprises an upper section which is a cuplike member having an open bottom, the lower peripheral edge being an annular channel; a lower section which is a cuplike member having an open top, said cuplike members providing an internal reservoir for storage of cleaning solution formed upon dissolution of a water-soluble cake contained within said reservoir, the top peripheral edge of the lower section being disposed within said annular channel to define a discharge/refill conduit connecting said reservoir with the body of liquid and comprising two chambers in fluid communication with each other, one chamber being adjacent to said reservoir to form an air trap chamber and the other being adjacent to said body of liquid to form an air refill chamber, a transfer port connecting said air trap and air refill chambers, the cross-sectional area of said transfer port normal to fluid flow being smaller than the cross-sectional area of said air trap chamber normal to fluid flow such that air in said conduit is not completely displaced by said liquid when the level of the body of liquid rises from said second elevation to the first elevation, the air being entrapped in said air trap chamber and forming, upon cessation of flow into the reservoir, an air lock in said conduit that substantially isolates said solution from the body of liquid, and vent means above the discharge/refill conduit fluid communication with said reservoir.

BRIEF DESCRIPTION OF THE DRAWINGS

FIG. 1 is a half-section perspective view of the preferred embodiment of the passive dispenser of the present invention.

FIGS. 3–7 are simplified front elevational views of the sectioned dispenser shown in FIG. 1, showing separate stages of the flush and refill cycles.

FIGS. 8–11 show the levels of liquid in the discharge/refill conduit as the liquid level in the tank rises during the refill cycle.

DESCRIPTION OF THE PREFERRED EMBODIMENT OF THE INVENTION

According to the present invention, there is provided a passive dispenser of simple construction adapted for placement in the bottom of the toilet tank away from the various mechanisms and linkages associated therewith, which dispenser is further adapted to substantially isolate the solution contained therein from the tank water during quiescent periods, i.e., between flushes, by providing an inlet/discharge conduit designed to facilitate the formation of an air lock within said conduit during the quiescent period.

Figure 2:
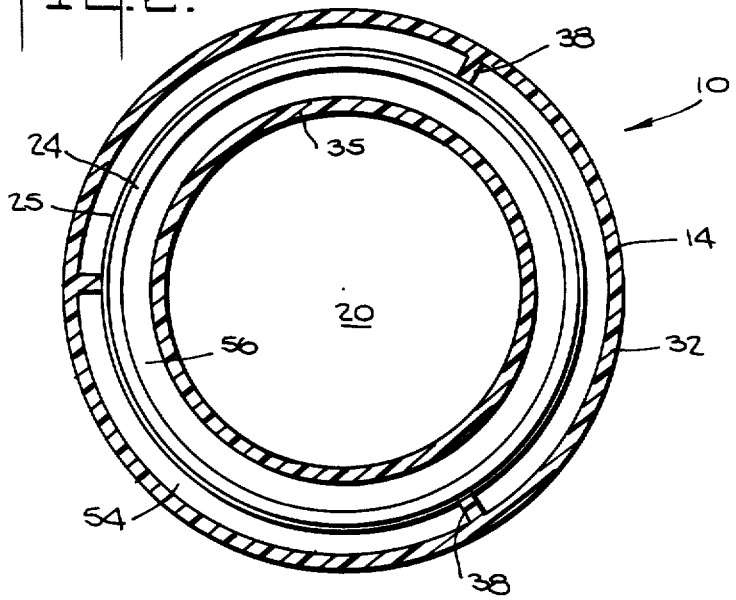
FIG. 2 is a cross-sectional view shown in FIG. 1 across Section 2—2.

Referring to FIGS. 1 and 2, the dispenser 10 comprises a cuplike lower section 12 and an upper section 14 provided as a closure for said lower section 12, there being therewithin an internal reservoir 20 for the storage of cleaning solution between flushes, as will be described in greater detail below.

The lower section, which has an open top, has a bottom wall 21 and circular side wall 22, the circular side wall 22 having a top portion that is a vertical wall segment 24, which wall segment 24 is, in the embodiment shown, reset inwardly and which is provided with exterior threads 25. A water-soluble cake 30 containing active cleaning materials is provided in the bottom of the lower section 12, in the internal reservoir 20, which cake 30 is described below.

The upper section 14, which has an essentially open bottom, has a top wall 31 and a circular side wall 32, vent means 44 extending upwardly from the top wall 31, as is described below in greater detail. Extending inwardly from and normal to the wall 32 proximate the lower edge 33 thereof is horizontal partition 34, from the distal edge of which extends downwardly a vertical partition 35. The partition 35 forms with vertical circular side wall segment 36 of sidewall 32 an inverted annular channel 37. Within the annular channel 37 is provided a plurality of L-shaped ribs 38, said ribs having vertical legs 39 adjacent segment 36 and horizontal legs 40 adjacent partition 34. The legs 39 are provided with grooves 42 to receive the threads 25 in the vertical segment 24 of the lower section 12, to permit connection of the upper and lower sections of the dispenser 10.

In assembly the annular channel 37 receives top portion 24, to define a refill/discharge conduit designated generally as element 50 through which conduit water enters as the height of water in the tank increases after a flush, and through which solution exits as the height of water in the tank decreases upon a flush.

The sidewall 32 could be positioned so that it is coplanar with vertical partition 35, the horizontal partition 34 and the segment 36 then being exterior of the wall 32. The vertical wall segment 24 could then be flared outwardly from the wall 22, the wall 22 being aligned with the recessed wall 32 of upper portion 14. These changes would serve to reduce the size of the internal reservoir 20, but would not modify operation of the unit. Of course, the wall 22 could be completely linear, without diameter variation. Alternatively, the dispenser of the present invention may be fabricated in two vertical half-sections, with the lower section and upper section halves of each half-section being of unitary construction. In this embodiment the vertical half-sections are sealed, for example by heat sealing, radio-frequency sealing, or adhesive sealing, the sealing method used being a function of the construction materials. For example, heat sealing and radio-frequency sealing are preferred in the case of a thermoplastic material. When an embodiment such as the one described in this paragraph is made, the threaded connection may be eliminated, the wall segment 24 being integral with the legs 40 of the L-shaped ribs 38, the legs 40 providing the spacing between partition 34 and wall segment 24 for fluid flow.

In another embodiment the threads 25 may be provided with one or more stop members to prevent complete removal of the upper section 14 from the lower section 12, to prevent exposing of the chemicals therein to children. In addition, the legs 40 of the ribs 38 may be omitted (i.e., ribs 38 are then only vertical members 39 having grooves 42). The dispenser is then shipped so that wall segment 24 abuts partition 34, thereby sealing the unit, the user opening the unit to the limit provided by the stop members, which degree of opening is proper for proper operation of the unit. The stop members provided would be of the type that permits the upper and lower sections to be connected, but prevents disconnection, i.e., a resilient tab flared outwardly in the direction of closing.

Referring back to FIG. 1, a vent means is provided at the top of the dispenser 10 to permit air to escape from the internal reservoir 20 during filling, which vent means is in simplest aspect an aperture, as, for example, in the case where the dispenser is positioned so that the height of water in the tank is below the top 31 of the upper section 14, at high tank water level. Alternatively, the vent means can be a conduit of such length as to extend above the high water level of the tank. Preferably, as shown in FIG. 1, the vent means 44 comprises a vertical tube 45 having a cap 46, the cap 46 having side wall 47 extending downwardly around the tube 45 to form an annular channel 48, there being one or more apertures 49 within the tube 45 above the lowermost edge of the wall 47 to provide fluid communication between the tube 45 and the channel 48.

The conduit 50 is formed by the projection of the wall segment 24 within the annular channel 37 and comprises a pair of chambers 54, 56 which are in fluid communication only at their uppermost portion, adjacent horizontal partition 34. Chamber 54, which serves as an air refill chamber, is bounded by partition 34 and wall segments 24, 36; chamber 56, which functions as an air trap chamber, is bounded by partitions 34, 35 and wall segment 24, and is in communication with chamber 54 through opening or transfer port 58, which is defined as the opening whose cross-section is normal to flow parallel to the plane of the horizontal partition 34 and between the vertical segment 24 and the horizontal partition 34. As shown, both chambers 54, 56 have essentially a constant cross-sectional area across the plane normal to the side walls 22, 32 of the dispenser 10. As explained hereinbelow, the relationship between the cross-sectional areas of chambers 34, 36 and transfer port 58 is of primary importance in the present invention. The discharge/refill conduit 50 can be placed anywhere along side wall 22 above bottom wall 21, the only requirement being that the conduit be at an elevation below the venting means 44. That is, the height of the lower section is not especially critical, provided that there be sufficient volume in the bottom of the lower section 12 to accommodate the cake 30.

The cake 30 contained in the reservoir 20 is either a water-soluble disinfectant containing cake, bar, or packet that forms, upon dissolution, a concentrated disinfectant solution within said reservoir, or a water-soluble surfactant containing cake, bar, or packet that forms, upon dissolution, a concentrated surfactant solution within said reservoir, the solution formed being available for release into the tank when the tank level is lowered. Preferably, only a portion of the disinfectant solution or the surfactant solution formed within the reservoir is dispensed each time the tank water level is lowered.

The disinfectant cake comprises a disinfectant agent, for example, a halogen-releasing agent such as an alkali or alkaline earth metal hypochlorite, especially sodium, potassium and calcium hypochlorite. Other disinfectant agents that can be used are, for example, chloramine derivatives, i.e., sodium benezenesulfonchloramine, sodium para-toluenesulfonchloramine, and para-toluenesulfondichloramide; halogenated hydantoins, i.e., 1,3-dichloro-5,5-dimethylhydantoin, 1-bromo-3-chloro-5,5-dimethylhydantoin, and 1,3-dibromo-5,5-dimethylhydantoin; and isocyanurates, i.e., sodium dichloroisocyanurate and trichloroisocyanuric acid. The disinfectant cake can also include other constituents such as binders to provide strength to the cake, both in the dry state to facilitate handling and in the wet state to prevent disintegration; lubricants, and buffering agents. Dyes are specifically not incorporated in the disinfectant cake in view of chemical interaction with the disinfectant agent. Conventional binders, fragrances, lubricants and buffering agents are used.

The disinfectant cake contains an amount of disinfectant that provides a useful dispenser life of from about two to three weeks to about several months, based on normal household use of about 10 to 20 flushes per day. Typically, this criteria suggests a disinfectant cake of from about 15 to 150 grams, the disinfectant therein being at least 30% by weight. The remainder comprises on a weight basis up to 70% binder, less than 15% of the buffering agent, and up to about 5% of the lubricant. The wide variation in cake size and disinfectant amount for the typical disinfectant cake exists in view of different solubilities of the disinfectant agents and in view of the varying bacteriostatic activities thereof.

The surfactant cake comprises a cleaning composition comprising one or more surfactants selected from the group consisting of anionic, nonionic, cationic, and amphoteric surfactants. Other constituents that can be included in the surfactant cake are dyes, fragrances, binders, thickeners, fillers, solubility control agents, and buffering agents. It is preferred that the fragrance and buffering agent be incorporated in the surfactant cake rather than the disinfectant cake. Binders are typically not required in the surfactant cake, the surfactant materials generally forming cakes of suitable dry and wet strength. Conventional binders, fragrances, thickeners, dyes, fillers, solubility control agents, and buffering agents are used.

The anionic surfactants include alkali metal alkyl, alkenyl and alkyaryl sulfate and sulfonate salts of the general formulas $ROSO_3M$ and $RSO_3M$, respectively, wherein R is an alkyl or alkenyl of 8 to 20 carbon atoms, or an alkylaryl group, the alkyl portion of which is a straight or branched aliphatic chain of 9 to 15 carbons, the aryl portion of which is a phenyl, and M is an alkali metal, e.g., sodium, potassium or lithium, or an amine or ammonium. The anionic surfactant may also be an alkali metal salt alkyl phenol ethylene oxide ether sulfate with between 1 to 10 ethylene oxide units per molecule, the alkyl radical containing from 8 to 12 carbon atoms. A preferred anionic surfactant is sodium alpha-olefin sulfonate available as flakes from Lakeway Surfactant under the trade name Siponate 301-10F.

The nonionic surfactant may be an alkylene oxide condensate, an amide or a semi-polar agent. The alkylene oxide condensates include polyethoxylated aliphatic alcohols, the alkyl chain having between 8 to 20 about carbon atoms, and the number of ethylene oxide units being between 4 and 12; polyethoxylated alkyl phenols wherein the alkyl group contains between 6 and 12 atoms and the number of ethylene oxide units between 50 to 25; difunctional blocks polymers of polyoxyalkylene derivatives of propylene glycol, and tetrafunctional polyether block polymers of polyoxyalkylene derivatives of ethylenediamine. Amide-type nonionics are the ammonia and ethanolamides of fatty acids whose acyl portion contains from 8 to 18 carbon atoms, while the semi-polar type nonionics are the amine oxides, phosphine oxides and sulfoxides. Preferred nonionics are condensates of ethylene oxide with hydrophobic bases formed by condensing propylene oxide with propylene glycol. Exemplary of this surfactant group are the surfactants sold under the trademark Pluronic by BASF Wyandotte, e.g., Pluronic F-108 and Pluronic F-127. Also preferred are tridecyl- and decyloxypoly(ethyleneoxy) ethanols sold under the trade name Emulphogene by GAF Corporation, e.g., Emulphogene TB-970, a tridecyloxypoly(ethyleneoxy) ethanol in flake form.

Cationic surfactants can be incorporated into the surfactant cake. Because cationic surfactants are typically incompatible with anionic surfactants, the use of cationics is generally limited to anionic free cakes, wherein the cationic surfactant is incorporated to provide germicidal activity or to regulate the surfactant solution properties. Exemplary of cationic surfactants suitable herein are alkyl dimethyl benzyl ammonium chlorides, i.e., Ammonyx T and BTC 1326 sold by Onyx Chemical Company; ammonium chlorides, i.e., BTC-1100R sold by Onyx Chemical Company and the Triton RW-Series surfactants sold by Rohm and Haas Company, which have the chemical formula $RNH(OCH_2CH_2)_nOH$, wherein n=1 to 15.

Suitable amphoteric surfactants include betaine derivatives, e.g., coco betaines such as Ampho B11-34 sold by Capital City Products, cocoamidopropyl betaine such as Cycloteric BET C-30 sold by Cyclo Chemicals; imidazolines, e.g., lauric-based imidazoline amphoteric, monocarboxylic sold by Quad Chemicals under the trade name Carsonam L; and the diethanolamine and sodium salts of dicarboxylic tall oil and coconut oil derivates, e.g., Miranol C2M sold by Miranol Chemical Co. The amphoteric surfactants are preferably used in combination with the anionic or nonionic surfactants and are incorporated within the cake to regulate foaming and other properties of the surfactant solution.

The surfactant cake contains an amount of surfactant that provides cleaning over the useful life of the dispenser, as noted above with respect to the disinfectant cake. A typical surfactant cake ranges from 20 to about 150 grams, the surfactant therein being at least about 30% by weight. Preferably dye and fragrance are incorporated into the surfactant cake, each being present in amounts of between 2 to 15% of the cake by weight. The amount of dye and fragrance incorporated within the cake is, of course, dependent upon the efficacy of the agent selected, and should be sufficient to provide activity for the useful life of the dispenser. A suitable dye is FD&C Blue No. 1, C.I. No. 42,090. Preferably, the surfactant cake is a combination of several surfactants, thereby regulating the dissolution characteristics of the cake as well as the physical properties of the surfactant solution. A preferred surfactant cake comprises on a weight basis between about 15 to 50% Pluronic nonionic surfactant, between about 10 to 40% Emulphogene nonionic surfactant, about 10 to 40% alpha-olefin sulfonate anionic surfactant, between about 5 to 12% dye, and from 5 to 12% fragrance.

The disinfectant cake is contained within the reservoir chamber to prevent leakage of the disinfectant, an oxidizing agent, into the tank water. If not isolated, high concentrations of disinfectant might otherwise occur in the tank water during extended periods of nonuse. This is especially true where the disinfectant contained within the cake has a high affinity for water, and would therefore tend to diffuse rapidly into the tank water. Hence, by maintaining the disinfectant isolated from the tank water during quiescent periods, disinfectant is depleted during the dispensing operations only. A further advantage is that the disinfectant agent does not interact with the dye (and other chemicals) in the surfactant cake of a dual dispensing device.

It is another aspect of the present invention to codispense simultaneously both a disinfectant solution and a surfactant solution from separate reservoirs, which can be accomplished, by manufacture of the dispenser to incorporate a vertical partition. In such dispensing unit, however, the individual reservoirs must be completely sealed one from the other. Hence, manufacture of the dispenser as a lower section and an upper section for subsequent assembly is not advantageous because of difficulties in properly sealing the two reservoirs. In this instance to manufacture the unit in two vertical half-sections, each having a separate vent means. After filling of the half-sections with the solution forming material, the dispenser could be sealably assembled by providing a planar wall member thereinbetween. Manufacture of such a dispenser would most preferably be with a thermoplastic material capable of being shaped by suitable molding methods and capable of being sealed by conventional methods, for example by heat sealing, radio frequency sealing or adhesive bonding. Preferably, the embodiment described in this paragraph would be fabricated by injection molding techniques well known in the art.

FIGS. 3–7, schematic front views of the sectioned dispenser 10 of FIG. 1, illustrate sequentially a refill and discharge cycle of the dispenser. For simplicity, these schematic illustrations do not include the threads 25 of the lower section 12, and show wall 22 of the lower section 12 as completely vertical.

FIG. 3 shows the dispenser at the bottom of the toilet tank 60 after a flush and as the tank is beginning to refill, water being already present in chamber 54 above the bottom edge 33 of wall segment 36. Thus, an air pocket is shown to exist in the discharge/refill conduit 50. A residual amount of solution **30*a* was retained in reservoir 20 after the flush, as hereinafter described, although the reservoir is dry in the initial use of the dispenser 10. In FIG. 4 the water level L in the tank has risen above partition 34. Because of the difference in hydraulic pressure outside and inside dispenser 10, water flows over wall segment 24 to initiate filling of internal reservoir 20. However, the water flow entering the reservoir 20 through conduit 50 is insufficient to displace the air bubble 51 in air trap chamber 56, the air bubble 51 being adjacent partition 50. As more water enters the toilet tank, water level L in the tank continues to rise, with the level in reservoir 20 also rising. When water level L in the tank rises above wall 47 of cap 46 and the dispenser 10 is filled, air pocket 52 is formed within the venting means 44 as shown in FIG. 5, the dispenser 10 being completely immersed in the tank water. In FIG. 5 the air bubble 51 has moved across the top of conduit 50, adjacent partition 34 and straddling transfer port 58. As a result of the presence of air pockets 51 and 52 in the conduit 50 and in the vent means 44, respectively, the solution 30*a* in reservoir 20** is isolated from the tank water during quiescent periods between flush and refill cycles.

When the toilet bowl is flushed, water level L in the tank 60 drops rapidly, as shown in FIG. 6. The solution **30*a* in reservoir 20 flows into the tank through the discharge/refill conduit 50 in view of the hydraulic head differential between the level L and the level in the dispenser 10. Thus, the flow out of reservoir 20 is gravimetric and siphoning is not involved. When water level L drops to its lowest point, as shown in FIG. 7, a major portion of the solution 30*a* stored in the reservoir 20 has been dispensed into the tank, the solution remaining in reservoir 20 being retained in lower section 12. When the tank water reaches its lowest level, flow out of the tank into the toilet bowl is cut off and the tank is refilled through a ballcock valve (not shown) in the tank. As the tank is refilled, the cycle shown in FIGS. 3–5** is repeated.

The amount of solution **30*a* dispensed into the tank is a function of the volumne of reservoir 20. The concentration of the solution also varies, and is a function of the volume of water in reservoir 20 and the attainment of equilibrium therein. The volume and concentration parameters can be altered in various ways. For example, a portion of the volume of cake 30 may comprise insoluble inerts. Two or more additives, each having the same function but with different solubility rates, may be employed to regulate the useful life of the dispenser. Similarly, time release could be achieved by encapsulating additives with inert materials of varying solubility. Because a residual volume of solution remains after a flush, the dispensing of at least a dilute solution is always assured, as in the case of a second immediate use of the dispenser. The volume of residual solution is determined by the height of wall segment 24** inasmuch as the use of a siphon is not employed.

Figure 9:
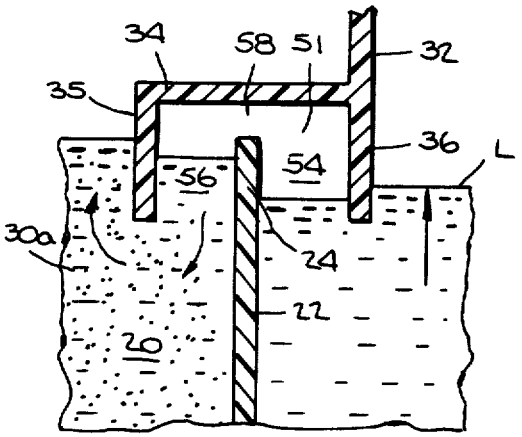
Figure 10:
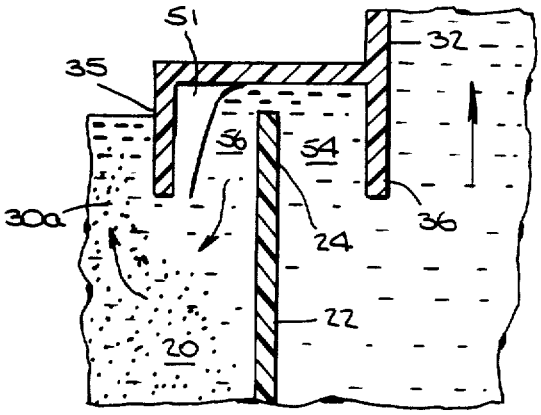
Figure 11:
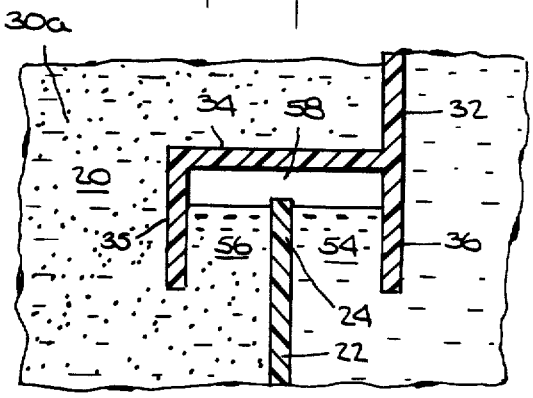

The dimensions for chamber 56 and transfer port 58 are of critical importance in the present invention, as hereinafter described with reference to FIGS. 8–11. FIG. 8 shows water level L rising as the tank is being filled after flushing. In FIG. 9 the water level L in the tank has risen above wall segment 36 causing air within conduit 50 to displace solution 30*a* in air trap chamber 56 thereby forming air bubble 51. As water level L rises still further (FIG. 10), water flows over vertical wall segment 24 and into air trap chamber 56, as well as reservoir 20. In a properly designed conduit 50, the air bubble 51 is retained in chamber 56 adjacent partition 34 and in the quadrant of the dispenser 10 defined by partitions 34 and 35, notwithstanding the filling of the reservoir 20 through chambers 54, 56. When flow into the dispenser terminates, the air bubble 51 transpositions itself across the top of the conduit 50 and straddles the transfer port 58 as depicted in FIG. 11. When the tank is flushed, the water level L drops rapidly, the air bubble 51 across transfer port 58 having an insufficient volume to prevent flow from the reservoir 20 into the tank. As a result, air in transfer port 58 is typically pushed out through chamber 54 and into the tank, followed by the solution 30*a* in reservoir 20.

The cross-sectional area of the transfer port 58 is smaller than the cross-sectional area of the air trap chamber 56 to achieve the formation and retention of the air bubble 51 in said chamber 56. By providing a transfer port 58 with a smaller cross-sectional area than the chamber 56, the air refill chamber 54 is caused to be flooded, as shown in FIG. 10, under the toilet tank fill rates generally encountered. Hence, air retained in the discharge/refill conduit 50 is retained in the air trap chamber and not swept through the air trap chamber. In addition, in view of the smaller transfer port cross-sectional area and the substantially rectangular configuration of the air trap chamber 56, the size of the air bubble 51 that is retained in the air trap chamber 56 is sufficient to fill the topmost portion of the discharge/refill conduit 50, and overlies the top of partition 24 during the quiescent period, as shown in FIG. 11.

The cross-sectional areas of chambers 54, 56 may be different, the relative proportions thereof being such that the air retained in the air trap chamber 56 is sufficient to fill the topmost portion of discharge/refill conduit 50. It is preferred that the chambers 54, 56 have substantially equal cross-sectional area of air trap chamber 56 be substantially constant and have a substantially rectangular configuration, as previously indicated.

The passive dispensers of the present invention can be made of any suitable material using known manufacturing techniques. For example, the dispensers can be made by adhesively securing sections of relatively rigid Plexiglass TM (a product of Rohm & Haas Company). As another example, the upper and lower sections of the dispenser may be vacuum thermoformed of a material as polyvinyl chloride, the solid, water-soluble bar inserted therein and, thereafter, the two sections assembled. Other polymeric materials which can be used to form the present dispensers include polyethylene, polypropylene, styrene copolymers, acrylics and the like. Alternatively, two vertical halves of the dispenser may be molded, each half comprising a portion of the upper and lower sections, which are then assembled by heat sealing or other suitable methods.

Figure 12:
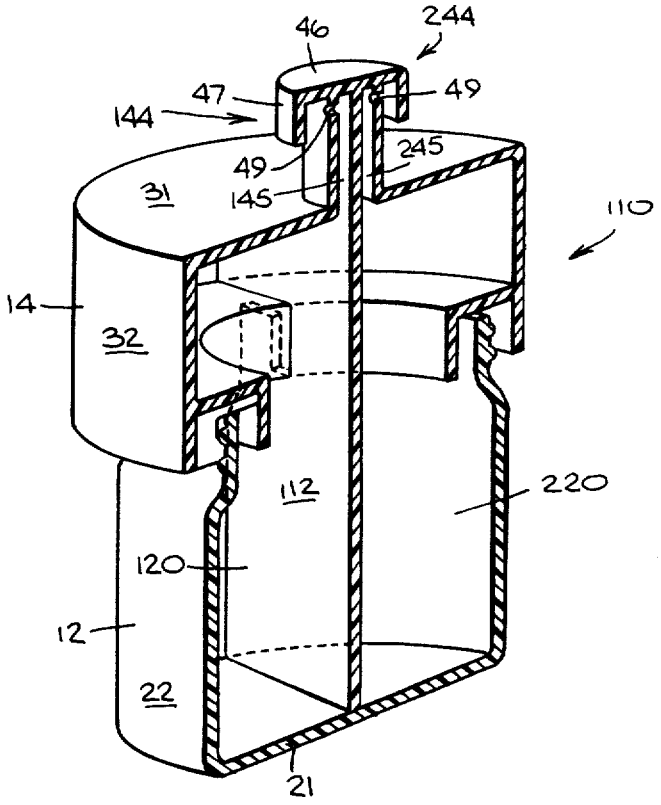
FIG. 12 is a half-section perspective view of an alternate embodiment of the passive dispenser of the present invention.

FIG. 12 illustrates another embodiment 110 of the dispenser of the present invention, wherein a first reservoir 120 and a second reservoir 220 are formed by means of vertical partition 112. (In FIG. 12 elements in common with the embodiment 10 of FIG. 1 have been assigned the same numerical designation.) As shown in FIG. 12, the vertical partition may be formed integrally with the upper section 14. Alternately, the vertical partition may be formed integrally with the lower section 12, or may be a separate element retained with the dispenser by interference (friction) fit by other attachment means. Reservoir 120 is provided with a first vent means 144, and reservoir 220 is provided with a second vent means 244. As shown in FIG. 12, the vent means 144 and 244 each comprise a vertical conduit, i.e., conduits 145 and 245, respectively, the vertical conduits 145 and 245. Each of said conduits has at least one aperture 49. A cap 46 overlies said conduits, said cap forming with the conduits an annular channel 48 whose sidewall extends below said apertures. Alternately, separated vent means that do not include as a common wall the vertical partition 112 may be provided for each reservoir 120 and 220 which extend upwardly from top surface 31. By providing the two reservoirs 120 and 220, the dispenser is adapted to codispense a disinfectant solution and a surfactant solution by dissolution of a disinfectant cake (not shown) and a surfactant cake (not shown).

I claim:

1. A nonsiphoning passive dispenser for containing a quantity of solution substantially isolated from a body of liquid and for causing a predetermined volume of said solution to issue from the dispenser solely under conditions of gravity flow in response to the level of said body of liquid being lowered from a first elevation to a second elevation, said dispenser adapted for placement at the bottom of said body of liquid, the dispenser comprising:

an upper section which is a cuplike member having an open bottom, the lower peripheral edge being an annular channel;

a lower section which is a cuplike member having an open top, the top peripheral edge of the lower section being disposed within said annular channel to define a discharge/refill conduit and said cuplike members providing an internal reservoir for storage of cleaning solution formed upon dissolution of a water-soluble cake contained with said reservoir, the discharge/refill conduit connecting said reservoir with the body of liquid and comprising two chambers in fluid communication with each other, one chamber being adjacent to said reservoir to form an air trap chamber and the other being adjacent to said body of liquid to form an air refill chamber, a transfer port connecting said air trap and air refill chambers, the cross-sectional area of said transfer port normal to fluid flow being smaller than the cross-sectional area of said air trap chamber normal to fluid flow such that air in said conduit is not completely displaced by said liquid when the level of the body of liquid rises from said second elevation to the first elevation, the air being entrapped in said air trap chamber and forming, upon cessation of flow into the reservoir, an air lock in said conduit that substantially isolates said solution from the body of liquid, and vent means above the discharge/refill conduit for air to vent from said reservoir.

2. The dispenser of claim 1 wherein the air trap chamber is substantially rectangular in vertical cross-section, the air being entrapped in an upper corner of the air trap chamber adjacent the reservoir when the level of the body of liquid rises from the second to the first elevation.

3. The dispenser of claim 2 wherein the vent means provides an air lock between the reservoir and the body of liquid.

4. The dispenser of claim 3 wherein said vent means comprises a vertical conduit extending from the top of the upper section, said conduit having one or more apertures proximate the top thereof, and a cap over the conduit, said cap forming with the conduit an annular channel whose sidewall extends below said apertures.

5. The dispenser of claim 3 wherein the cross-sectional area of the air refill is substantially the same as the cross-sectional area of the air trap chamber.

6. The dispenser of claim 2 wherein the level at which the air trap chamber is in fluid communication with the reservoir is no higher than the level at which the air refill chamber is in fluid communication with the body of liquid.

7. The dispenser of claim 1 wherein the air trap chamber has vertical sidewalls, the bottom thereof being in fluid communication with the reservoir, and wherein the air refill chamber has vertical sidewalls, the bottom thereof being in fluid communication with the body of liquid, said chambers having a collinear horizontal top wall.

8. The dispenser of claim 1 wherein the upper section and lower section are threadedly connected.

9. The dispenser of claim 8 wherein stop means are provided to prevent disassembly of the upper and lower sections.

10. The dispenser of claim 1 wherein said dispenser is fabricated in vertical half-sections, which half-sections are sealably attached to one another.

11. The dispenser of claim 10 wherein said lower section and said upper section half-sections are of unitary construction.

12. The dispenser of claim 1 further comprising a vertical partition to provide a first and a second reservoir, said first reservoir containing a disinfectant cake and said second reservoir containing a surfactant cake, said dispenser codispensing disinfectant solution and surfactant solution, each reservoir having separate vent means therefor.

13. The dispenser of claim 12 wherein the air trap chamber is substantially rectangular in vertical cross-section, the air being entrapped in an upper corner of the air trap chamber adjacent the reservoir when the level of the body of liquid rises from the second to the first elevation.

14. The dispenser of claim 13 wherein each vent means comprises a vertical conduit extending from the top of the upper section, said conduit having one or more apertures proximate the top thereof, and a cap over the conduit, said cap forming with the conduit an annular channel whose sidewall extends below said apertures.

* * * * *